US005490767A

United States Patent [19]

Kanou et al.

[11] Patent Number: 5,490,767

[45] Date of Patent: Feb. 13, 1996

[54] VARIABLE DISPLACEMENT PISTON TYPE COMPRESSOR

[75] Inventors: Hiroshi Kanou, Takasaki; Kiyoshi Terauchi, Isesaki; Isamu Fukai, Fujioka; Toshiyuki Ogura, Yamada, all of Japan

[73] Assignee: Sanden Corporation, Gunma, Japan

[21] Appl. No.: 114,244

[22] Filed: Aug. 31, 1993

[30] Foreign Application Priority Data

Sep. 2, 1992 [JP] Japan ..... 4-067247 U

[51] Int. Cl.[6] ..... F04B 1/26; F04B 1/16

[52] U.S. Cl. ..... 417/222.1; 417/269; 92/71

[58] Field of Search ..... 91/505; 92/12.2, 92/71; 417/222.1, 269

[56] References Cited

U.S. PATENT DOCUMENTS

| | | | |
|---|---|---|---|
| 1,076,807 | 10/1913 | Anderson | 92/71 |
| 1,229,009 | 6/1917 | Allison | 92/71 |
| 1,781,068 | 3/1922 | Michell . | |
| 2,048,272 | 7/1936 | Linthicum . | |
| 2,386,675 | 10/1945 | Ford . | |
| 4,101,250 | 7/1978 | Nakayama et al. | 417/269 |
| 4,285,640 | 8/1981 | Mukai . | |
| 4,776,259 | 10/1988 | Takai . | |
| 4,782,739 | 11/1988 | Saito . | |
| 4,789,311 | 12/1988 | Ikeda et al. | 417/269 |
| 4,874,045 | 11/1988 | Terauchi . | |
| 4,875,834 | 10/1989 | Higuchi et al. . | |
| 4,954,050 | 9/1990 | Higuchi et al. . | |
| 5,015,154 | 5/1991 | Higuchi et al. . | |
| 5,032,060 | 7/1991 | Kobayashi et al. | 417/269 |
| 5,046,401 | 9/1991 | Shimizu . | |
| 5,382,139 | 1/1995 | Kawaguchi et al. | 417/269 |

FOREIGN PATENT DOCUMENTS 0259760 3/1988 European Pat. Off. .

*Primary Examiner*—Charles Freay
*Attorney, Agent, or Firm*—Baker & Botts

[57] ABSTRACT

A piston type compressor includes a compressor housing enclosing a crank chamber, a suction chamber, and a discharge chamber therein. The compressor housing comprises a cylinder block having a plurality of cylinders. A drive shaft is rotatably supported in the cylinder block. A plate is tiltably connected to the drive shaft and is coupled to a plurality of pistons which may be driven in a reciprocating motion within the cylinders upon rotation of the drive shaft. Each of the pistons is provided with a rotation prevention mechanism which may include a first rotation prevention device formed on the center of the piston and second rotation prevention device disposed within the compressor housing, the first and second rotation prevention devices cooperating to prevent the piston from rotating about its own axis. The first and second rotation prevention devices each have at least one sliding surface formed thereon. Further, the rotation prevention mechanism may include a rotation prevention device formed on a center of the piston, the rotation prevention device including at least two sliding surfaces formed on both radial sides of the piston, each sliding surface smoothly sliding on an adjacent sliding surface of an adjacent rotation prevention device so that the rotation prevention device and the adjacent rotation prevention device cooperate to prevent the piston from rotating about its own axis. The sliding surfaces of the rotation prevention mechanism may be formed to be fine surfaces by machining in a finishing process.

24 Claims, 9 Drawing Sheets

VARIABLE DISPLACEMENT PISTON TYPE COMPRESSOR

BACKGROUND OF THE INVENTION

1. Field of the Invention

The present invention generally relates to a piston type refrigerant compressor and, more particularly, to a swash plate type compressor with a variable displacement mechanism suitable for use in an automotive air conditioning system.

2. Description of the Prior Art

A swash plate type refrigerant compressor with a variable displacement mechanism suitable for use in an automotive air conditioning system is disclosed in Japanese Patent Application Publication No. 63-93480. Referring to FIG. 1, an outer shell of the compressor is formed by front housing 1, front valve plate 9, cylinder block 3, rear valve plate 4, and rear housing 5, which are made of an aluminum alloy. Cylinder block 3 comprises front cylinder block 3*a* and rear cylinder block 3*b* which abut each other. Front housing 1 is mounted through front valve plate 9 on one side of cylinder block 3, and rear housing 5 is mounted through rear valve plate 4 on the other side of cylinder block 3. These shell components are coupled in a unit by a plurality of bolts 6.

A plurality of cylinders 7, arranged in parallel with each other, and chamber 8 are formed by front and rear cylinder blocks 3*a* and 3*b* within cylinder block 3. Further, first bearing, 10 and second bearing 11 are disposed in cylinder block 3 and rear housing 5, respectively, to rotatably support drive shaft 12. Drive shaft 12 is arranged coaxially with the annular arrangement of cylinders 7. One end portion 13 of drive shaft 12 extends to the outside of front housing 1 through drive shaft sealing bearing 14 mounted on front housing 1. Exposed end portion 13 is connected to an electromagnetic clutch (not shown), so that the rotational torque of an automotive vehicle engine may be transmitted to drive shaft 12 through the electromagnetic clutch.

Piston 17 defines a front side working chamber 15 and a rear side working chamber 16 in cooperation with an inner surface of each cylinder 7 and is reciprocatingly inserted into each cylinder 7. Thus, each piston 17 may be slidably reciprocated by swash plate 18 disposed within crank chamber 8.

Swash plate 18 has a projection portion at its central region, and arm 19 is formed in the projection portion. Planar plate portion 20 is formed in drive shaft 12 at a position corresponding to arm 19 of swash plate 18. Swash plate 18 is obliquely mounted on drive shaft 12 with planar plate portion 20 engaged with arm 19. Also, pin 21 is fixed to the projection portion of swash plate 18. Pin 21 is engaged through a collar with elongated hole 22 formed in planar plate portion 20 of drive shaft 12. In this configuration, swash plate 18 is shifted between a position in which the slant angle is large and a position in which the slant angle is small, while pin 21 of swash plate 18 slides within elongated hole 22. The capacity of the compressor is dependent upon the slant angle of swash plate 18. When the slant angle of swash plate 18 is increased, the stroke length of piston 17 in cylinder 7 is maximized, and the capacity of the compressor is decreased. The rotational force of drive shaft 12 is transmitted to swash plate 18 through the engagement between planar plate portion 20 and arm 19. Swash plate 18 is driven to rotate about the axis of drive shaft 12 together with drive shaft 12 and to move in the axial direction of drive shaft 12. Thus, swash plate 18 is swung between a rightwardly upward inclination and a rightwardly downward inclination.

The circumferential peripheral portion of swash plate 18 is connected to piston 17 through a pair of shoes 23. Swash plate 18 is inserted slidingly into the space between the pair of shoes 23. Shoes 23 form a single spherical shape when in contact with swash plate 18 and rotatably mounted on recesses formed in piston 17 in a complementary manner. Accordingly, the swing motion concomitant with the rotation of swash plate 18 is transmitted to piston 17 through shoes 23, while the rotational motion component of swash plate 18 is released by shoes 23. Only the swing motion of swash plate 18 is converted into the reciprocating motion of piston 17 which is reciprocated within cylinder 7, so that the volume of front side working chamber 15 and rear side working chamber 16 are alternately increased and decreased.

Front housing 1 defines front suction chamber 24 and front discharge chamber 25. Drive shaft sealing bearing 14 is provided between front suction chamber 24, drive shaft 12, and front housing 1 to prevent the refrigerant, e.g., a mixture of refrigerant and lubricant, from leaking out. From suction chamber 24 is in communication with crank chamber 8 through a hole formed in front valve plate 9 and front passage 26 formed in cylinder block 3. Further, front suction chamber 24 is in communication with front side working chamber 15 through front suction hole 27 formed in front valve plate 9. Also, front discharge chamber 25 is in communication with front side working chamber 15 through front discharge hole 28 formed in front valve plate 9.

Front suction valve 29 in the form of a sheet is provided on the surface of front valve plate 9 within front side working chamber 15, so that front suction valve 29 is opened when piston 17 is rightwardly moved. Sheet-like discharge valve 30 is provided on the surface of front valve plate 9 within discharge chamber 25, so that discharge valve 30 is opened when piston 17 is leftwardly moved. Discharge valve 30 is converted by front valve retainer 31.

Rear housing 5 defines rear suction chamber 32 and rear discharge chamber 33. Rear suction chamber 32 is in communication with crank chamber 8 through a hole formed in rear valve plate 4 and rear passage 34 formed in cylinder block 3. Further, rear suction chamber 32 is in communication with rear side working chamber 16 through rear suction hole 35. Rear discharge chamber 33 is in communication with rear side working chamber 16 through rear discharge hole 36 formed in rear valve plate 4. Rear suction valve 37, rear discharge valve 38, and rear valve retainer 39 are mounted on rear valve plate 4 in a similar manner to that described for the corresponding front elements.

Switching valve 40 and control chamber.41 also are provided in rear housing 5. Slider 42 is rotatably mounted on drive shaft 12 to be slidable in the axial direction of drive shaft 12. Slider 42 is provided with spherical support portion 43 at one end thereof close to planar plate portion 20 of drive shaft 12. Spherical support portion 43 permits the central portion of swash plate 18 to rotate about the axis of drive shaft 12 and to move in the axial direction. Slider 42 has flange portion 44 which is connected to one end of spool 46 through second thrust bearing 45.

Spool 46 has annular piston portion 47 which is formed at the outer end of spool 46 and is inserted into rear suction chamber 32 to divide the chamber into rear suction chamber 32 and control chamber 41, and cylindrical portion 48 which extends coaxially with drive shaft 12 and slider 42 from piston portion 47 to the interior of cylinder block 3. Cylindrical portion 48 of spool 46 is slidably inserted into cylindrical portion 3*d* formed in rear cylinder block 3*b*. Thus, the motion of spool 46 in the axial direction is transmitted to slider 42 through second thrust bearing 45 and flange portion 44. First thrust bearing 49 is also provided on drive shaft 12 on the front side of planar plate portion 20 and is clamped between planar plate portion 20 of drive shaft 12 and retainer shoulder 3*c* provided in front cylinder block 3*a* to impart a thrust to drive shaft 12.

Referring to FIG. 2*a*, piston 17 includes piston head 17*b* at each end. Piston 17 is formed such that the middle portion of piston 17, namely coupling portion 17*c* which is substantially semicircular in section and through which two piston heads 17*b* are coupled together, is operatively connected with both sides of the peripheral portion of swash plate 18 through shoes 23. Supporting portion 17*d* which is formed inside of coupling portion 17*c* supports shoes 23.

The operation of the compressor will now be described. Referring to FIG. 1, when the above-described electromagnetic clutch is engaged to transmit the drive torque from the automotive vehicle engine, drive shaft 12 begins to rotate within cylinder block 3. The rotation of drive shaft 12 is transmitted to arm 19 and swash plate 18 to rotate the latter. Because swash plate 18 is slanted relative to drive shaft 12, swash plate 18 is swung in accordance with the rotation of drive shaft 12, so that piston 17 is reciprocated within cylinder 7 in accordance with this swing motion.

When the discharge displacement of the compressor must be kept at a maximum level, switching valve 40 is switched over to place control chamber 41 in communication with rear discharge chamber 33. Then the pressure applied to the right side of piston portion 47 of spool 46 is higher than the pressure applied to the left side, so that spool 46 moves leftwardly. At the same time, the central position of swash plate 18 and slider 42 are moved leftwardly, so that the left end of slider 42 is brought into contact with planar plate portion 20 of drive shaft 12. By the leftward movement of swash plate 18, the projection portion of swash plate 18 having pin 21 is moved leftwardly relative to planar plate portion 20 of drive shaft 12, ,so that pin 21 is moved along elongated hole 22 of planar plate portion 20 toward the left upward end. In accordance with the left upward movement of pin 21, swash plate 18 is rotated about the center of spherical support portion 43 of slider 42 to create a large slant angle.

Further, piston 17 is reciprocated within cylinder 7. As piston 17 reciprocates, the refrigerant is alternately drawn into and compressed within front and rear side working chambers 15 and 16.

The refrigerant is introduced to the compressor from the refrigerant cycle through crank chamber 8 to front and rear suction chambers 24 and 32 and exits to the refrigerant cycle through front and rear discharge chambers 25 and 33. As described above, swash plate 18 is moved in the axial direction of drive shaft 12, so that the slant angle is changed and the central position is located substantially at the center in the longitudinal direction of cylinder 7. Therefore, as piston 17 reciprocates through a complete stroke, a loss of compression is avoided in front and rear side working chambers 15 and 16. The refrigerant compressed in the same manner is discharged from either of front and rear side working chambers 15 and 16. Accordingly, the flow refrigerant is generated in either of front and rear side working chamber 15 and 16, drive shaft sealing bearing 14 is in contact with that flow refrigerant, and the heat generated due to the friction with drive shaft 12 is removed by the refrigerant.

When the discharge displacement of the compressor must be kept at a minimum level, the switching over of switching Valve 40 places control chamber 41 in communication with rear suction chamber 32. When drive shaft 12 is rotated under this condition, swash plate 18 causes piston 17 to move rightwardly. As a result of the reactive force applied to piston 17, a force decreasing the inclination angle of swash plate 18 is applied to swash plate 18. Namely, the force rotating swash plate 18 in a counterclockwise direction is applied to swash plate 18 by piston 17.

The force applied to swash plate 18 is limited because pin 21 is slidingly engaged with elongated hole 22, and a force pressing the central position of swash plate 18 to the right in the axial direction of drive shaft 12 is created. The force component is transmitted to spool 46 through slider 42. As described above, because the pressure difference is not generated between both sides of the piston portion 47 of spool 46, piston portion 47 moves rightwardly. Thus, the inclination angle of swash plate 18 is decreased and, at the same time, the central portion of swash plate 18 is moved toward rear side working chamber 16. The dead center position in rear side working chamber 16 is kept at substantially the same position as in the case of the above-described maximum displacement operation. Further, each piston 17 includes inner surface 300*c* formed on the inside thereof. A clearance of about 2 to 3 mm exists between radial end extremity 18*a* of swash plate 18 and each piston 17 because a swash plate compressor with variable displacement requires a relatively large clearance to vary the capacity of compression by changing the piston stroke.

Unfortunately, this relatively large clearance allows piston 17 to rotate within cylinder 7 and creates noise due to collisions between inner surface 300*c* of piston 17 and radial end extremity 18*a* of swash plate 18. Therefore, each piston 17 is provided with rotation prevention means 300 integrally formed on the center portion of piston 17 and extending radially therefrom. Referring to FIGS. 2*a* and 2*b*, rotation prevention means 300 includes first surface 300*a* formed on the upper surface thereof and second surface 300*b* formed on the radial end thereof. Rotation prevention means 300 is adapted to engage recess 310 formed in the wall of each cylinder 7. It will be seen that rotation prevention means 300 and recess 310 cooperate to prevent piston 7 from rotating about its own axis, thereby suppressing noise during operation of the compressor.

In this configuration, however, both the surface of recess 310 of cylinder block 3 and first surface 300*a* of rotation prevention means 300 are preferably formed as fine surfaces by machining in a finishing process in order to smoothly slide against each other. To cut and grind the surface of recess 310 of cylinder block 3 with a lathe and finishing tool consumes much time and energy because recess 310 is provided inside of cylinder block 3 which includes various projections impeding milling. Further, these above-described surfaces are relatively broad. As a result, this compressor has reduced productivity and a high manufacturing cost.

SUMMARY OF THE INVENTION

It is an object of the invention to provide a piston type compressor and, more particularly, a variable displacement swash plate type compressor which can be easily and inexpensively manufactured.

It is a further object of the invention to provide a piston type compressor and, more particularly, a variable displacement swash plate type compressor which has a superior durability relating to a piston rotation prevention mechanism.

According the present invention, a piston type compressor includes a compressor housing enclosing a crank chamber, a suction chamber, and a discharge chamber therein. The compressor housing comprises a cylinder block having a plurality of cylinders. A drive shaft is rotatably supported in the cylinder block. A plate is tiltably connected to the drive shaft. A bearing coupling the plate to a plurality of pistons is provided so that the pistons may be driven in a reciprocating motion within the cylinders upon the rotation of the drive shaft. Working chambers are formed between each end of each piston and the adjacent surfaces of each associated cylinder. A support portion is disposed coaxially with the drive shaft and tiltably supports a central portion of the plate. A tilt control means is provided for driving the support portion axially along the drive shaft to move the central portion of the plate axially along the drive shaft to change the angle of tilt of the plate. The pistons are slidably received in each of the cylinders and are adapted to be reciprocally moved in the cylinders in accordance with a tilting motion of the plate. Each piston is prevented from rotating about its own axis by a rotation prevention mechanism.

The rotation prevention mechanism includes a first rotation prevention device formed on a center of the piston and second rotation prevention device disposed within the compressor housing. The first rotation prevention device includes at least one sliding surface formed thereon and formed to be a fine surface by machining in a finishing process. The second rotation prevention device includes a sliding surface formed on a peripheral surface of the second rotation prevention device. The sliding surface of the first rotation prevention device smoothly slides on the sliding surface of the second rotation prevention device so that the first rotation prevention device and the second rotation prevention device cooperate to prevent the piston from rotating about its own axis.

Further objects, features, and advantages of the present invention will be understood from the detailed description of the preferred embodiments of the present invention with reference to the appropriate figures.

DETAILED DESCRIPTION OF THE DRAWINGS

Figure 1:
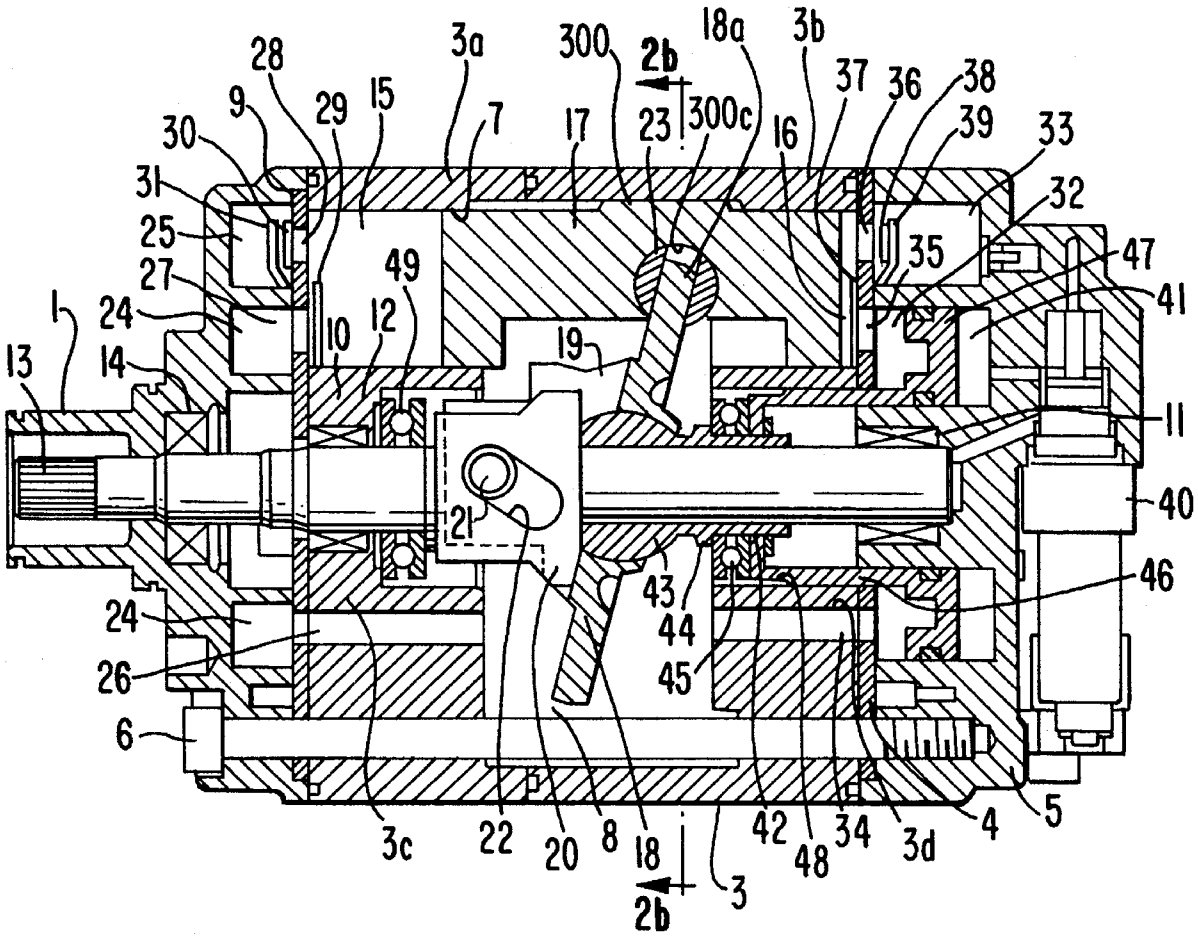
FIG. 1 PRIOR ART
FIG. 1 is a longitudinal cross-sectional view of a swash plate type refrigerant compressor with a variable displacement mechanism in accordance with the prior art.
Figure 2A:
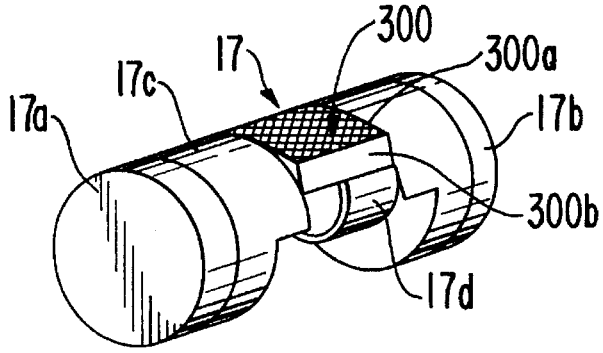
FIG. 2a (PRIOR ART)
FIG. 2*a* is a perspective view of a piston in the compressor shown in FIG. 1.
Figure 2B:
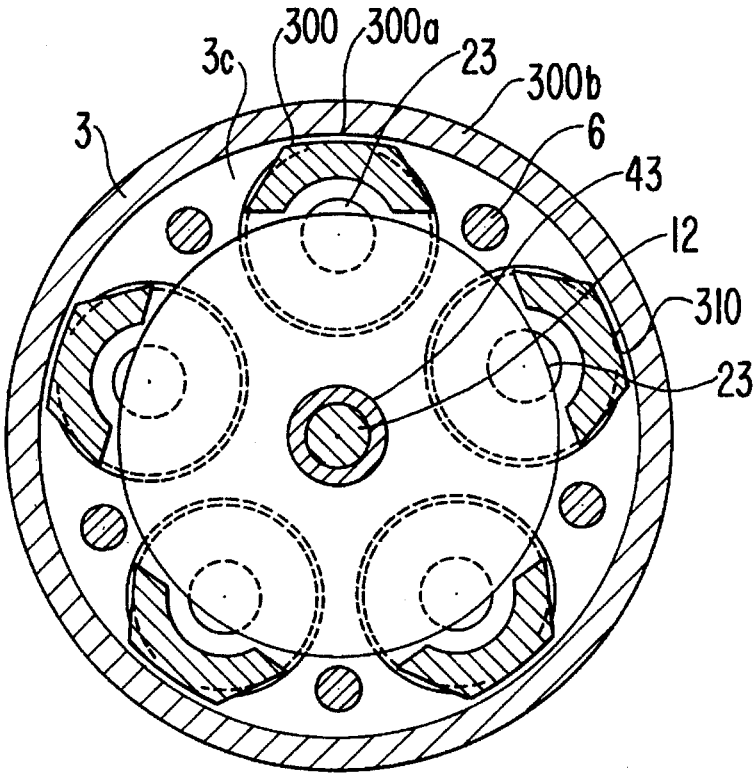
FIG. 2b (PRIOR ART)
FIG. 2*b* is a cross-sectional view taken along line 2*b*—2*b* in FIG. 1.

The preferred embodiments of the present invention are similar to the compressor shown in FIG. 1 except for the construction of the rotation prevention mechanism of the pistons within the cylinders. Therefore, similar parts are represented by the same reference numerals as in FIG. 1, and detailed descriptions of similar parts will be omitted in order to simplify the following description of the preferred embodiments. Moreover, although the following description of the preferred embodiments will refer to a swash plate type compressor, the present invention is not limited to a swash plate type compressor.

Figure 3A:
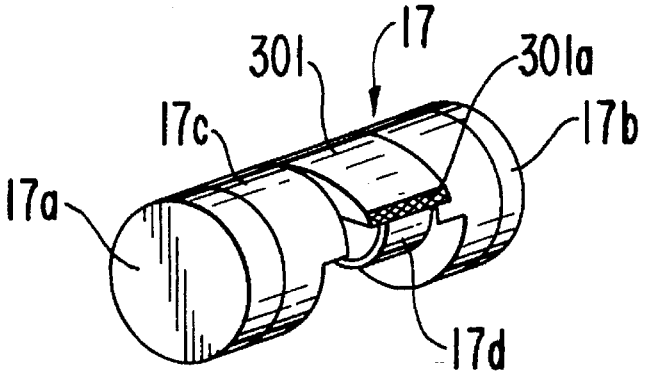
FIG. 3*a* is a perspective view showing a piston for use in a piston type compressor in accordance with a first embodiment of the present invention.
Figure 3B:
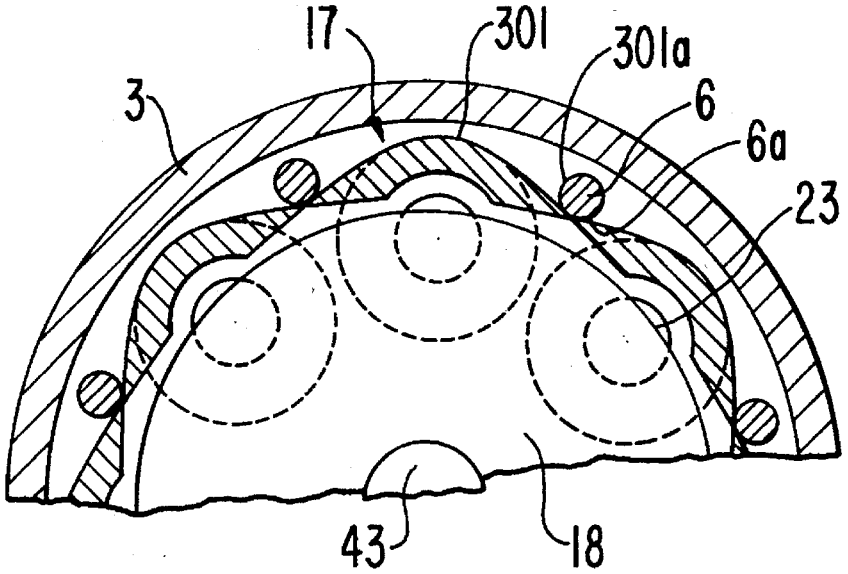
FIG. 3*b* is a cross-sectional view taken along line 2*b*—2*b* in FIG. 1 in accordance with the first embodiment of the present invention.

Referring to FIGS. 3*a* and 3*b*, piston 17 is depicted according to the first embodiment of the present invention. Piston 17 includes piston head 17*b* at each end thereof. Piston 17 comprises coupling portion 17*c* which is located at the center of piston 17 between piston heads 17*b*. Coupling portion 17*c* is substantially semicircular in section and couples two piston heads 17*b* together. Further, coupling portion 17*c* is operatively connected with both sides of the peripheral portion of swash plate 18 through shoes 23. Supporting portion 17*d* which is formed inside of coupling portion 17*c* supports shoes 23. Each piston 17 is provided with projection 301 integrally formed on, and arching and extending radially from, the center of coupling portion 17*c* of piston 17. Projection 301 includes radial end portions 301*a* having a tapered form. Bolts 6 are respectively arranged between each piston 17 through front housing 1, cylinder block 3, and rear housing 5, connecting them as one body and are in parallel with the longitudinal axis of drive shaft 12. Thus, an axis of each bolt 6 is radially and circumferentially offest from an axis of each piston 17. Both radial end portions 301*a* of projection 301 are slidably abutted to peripheral surfaces 6*a* of bolts 6, so that projection 301 and bolts 6 cooperate to prevent piston 17 from rotating about its own axis. Also, it should be noted that, as shown in FIG. 3*a* for example, a maximum radial thickness of projection 301 is smaller than the diameter of piston 17. The radial thickness is the dimension along a given radial extending outwardly from the centerline of the compressor.

Figure 4A:
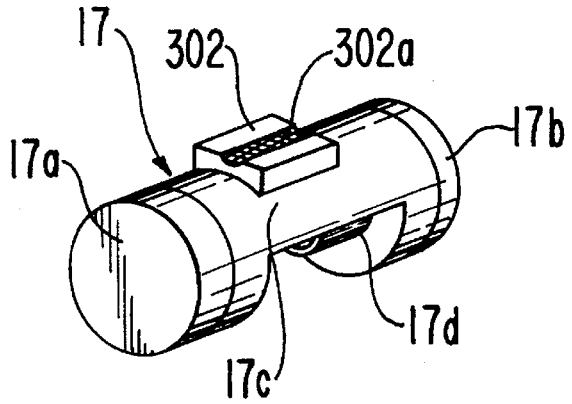
FIG. 4*a* is a perspective view showing a piston for use in a piston type compressor in accordance with a second embodiment of the present invention.
Figure 4B:
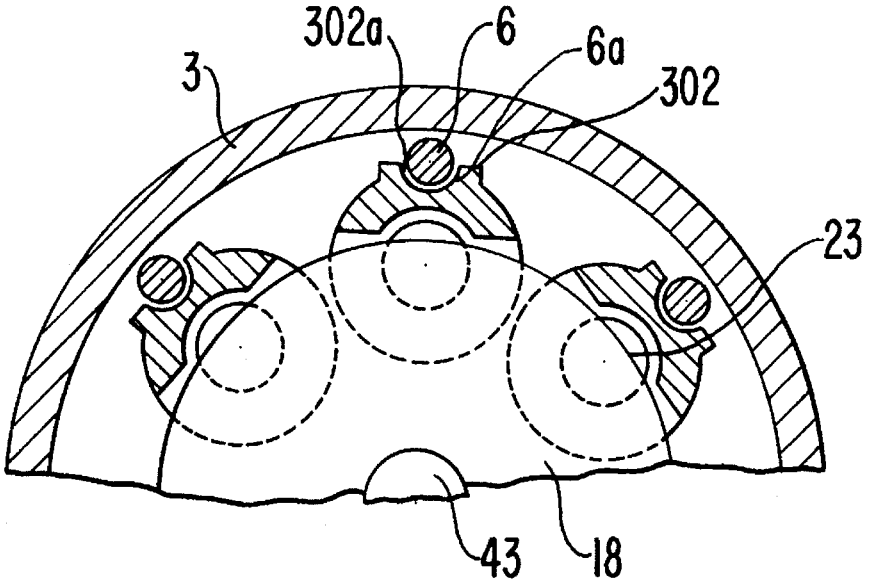
FIG. 4*b* is a cross-sectional view taken along line 2*b*—2*b* in FIG. 1 in accordance with the second embodiment of the present invention.

Referring to FIGS. 4*a* and 4*b*, piston 17 is depicted according to the second embodiment of the present invention. Piston 17 may include projection 302 which is rectangular and convex in shape at the surface of piston 17 and extends outward rectangularly from center coupling portion 17*c* of piston 17. Projection 302 includes groove 302*a* which is substantially semicylindrical in shape, is parallel with piston 17, and is formed on the end surface of projection 302. The peripheral surface 6*a* of bolt 6 is slidably adapted to fit in groove 302*a*, so that projection 302 and bolt 6 cooperate to prevent piston 17 from rotating about its own axis.

Figure 5A:
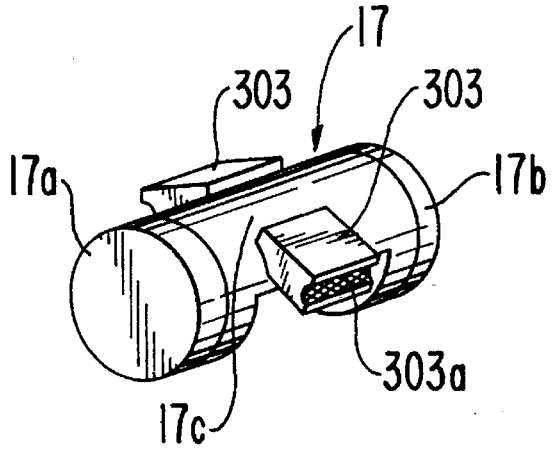
FIG. 5*a* is a perspective view showing a piston for use in a piston type compressor in accordance with a third embodiment of the present invention.
Figure 5B:
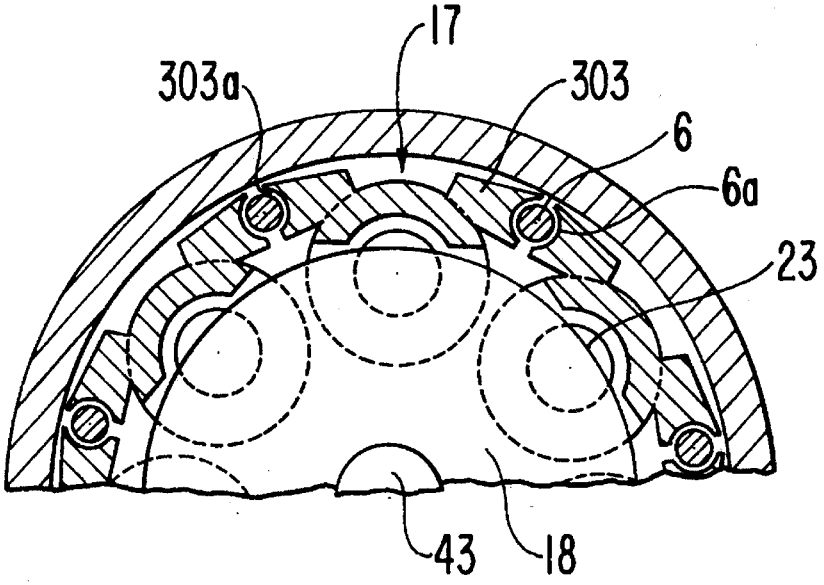
FIG. 5*b* is a cross-sectional view taken along line 2*b*—2*b* in FIG. 1 in accordance with the third embodiment of the present invention.

Referring to FIGS. 5*a* and 5*b*, piston 17 is depicted according to the third embodiment of the present invention. Piston 17 may include a pair of projections 303 which are wing shaped and extend from both sides of the center of coupling portion 17*c* of piston 17. Projections 303 include grooves 303*a* which are substantially semicylindrical in shape, are parallel with piston 17, and are formed on the end surfaces of projections 303. Peripheral surfaces 6*a* of bolts 6 are slidably adapted to fit in grooves 303*a* so that projections 303 and bolts 6 cooperate to prevent piston 17 from rotating about its own axis.

Figure 6A:
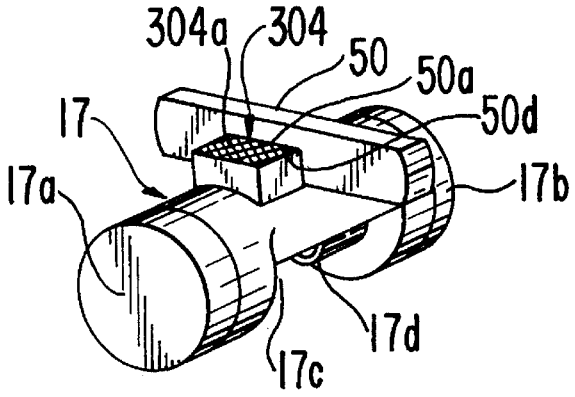
FIG. 6*a* is a perspective view showing a piston for use in a piston type compressor in accordance with a fourth embodiment of the present invention.
Figure 6B:
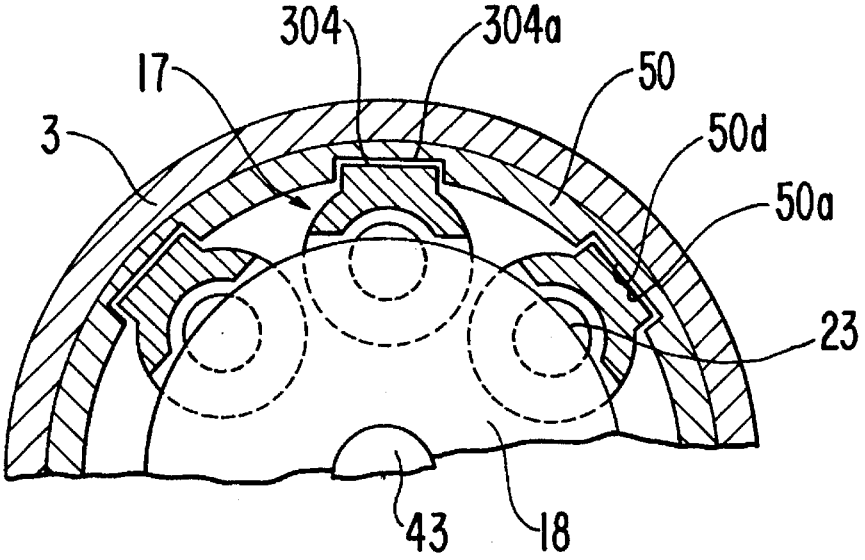
FIG. 6*b* is a cross-sectional view taken along line 2*b*—2*b* in FIG. 1 in accordance with the fourth embodiment of the prominent invention.

Referring to FIGS. 6*a* and 6*b*, piston 17 is depicted according to the fourth embodiment of the present invention. Piston 17 includes projection 304 which is rectangular and convex in shape at the surface of piston 17 and extends outward rectangularly from the center of coupling portion 17*c* of piston 17. Housing 3 is provided with ring member 50 which is shaped like a circular plate and is fixed to the inside of housing 3. Ring member 50 includes cutout portion 50*a* which is shaped like a rectangular notch and is cut out from the inner region of ring member 50. Outer peripheral surface 304*a* of projection 304 of piston 17 is slidably adapted to fit into peripheral surface 50*d* of cutout portion 50*a* of ring member 50, so that ring member 50 and projection 304 of piston 17 cooperate to prevent piston 17 from rotating about its own axis.

Figure 7A:
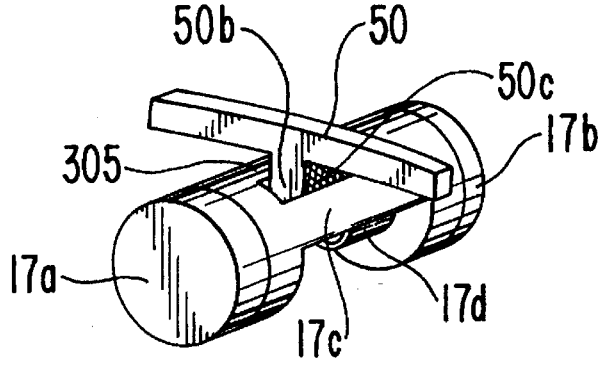
FIG. 7*a* is a perspective view showing a piston for use in a piston type compressor in accordance with a fifth embodiment of the present invention.
Figure 7B:
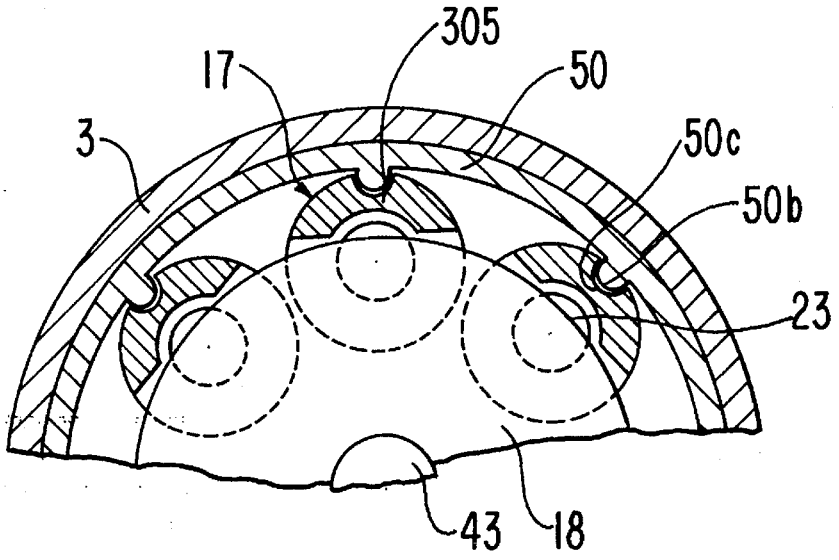
FIG. 7*b* is a cross-sectional view taken along line 2*b*—2*b* in FIG. 1 in accordance with the fifth embodiment of the present invention.

Referring to FIGS. 7*a* and 7*b*, piston 17 is depicted according to the fifth embodiment of the present invention. Each piston 17 may be provided with groove 305 which; is rectangular and convex in shape at the surface of piston 17 and is formed on the surface of, and extends axially along, coupling portion 17*c* of piston 17. Ring member 50 may include projections 50*b* which extend radially inward from ring member 50. Peripheral surfaces 50*c* of projections 50*b* of ring member 50 are slidably adapted to fit in groove 305 of piston 17, so that ring member 50 and groove 305 cooperate to prevent piston 17 from rotating about its own axis.

Figure 8A:
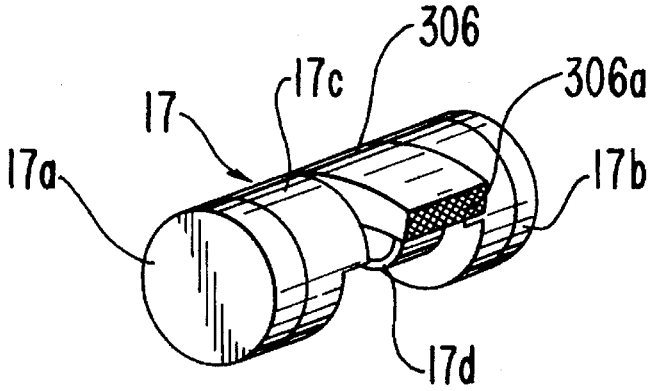
FIG. 8*a* is a perspective view showing a piston for use in a piston type compressor in accordance with a sixth embodiment of the present invention.
Figure 8B:
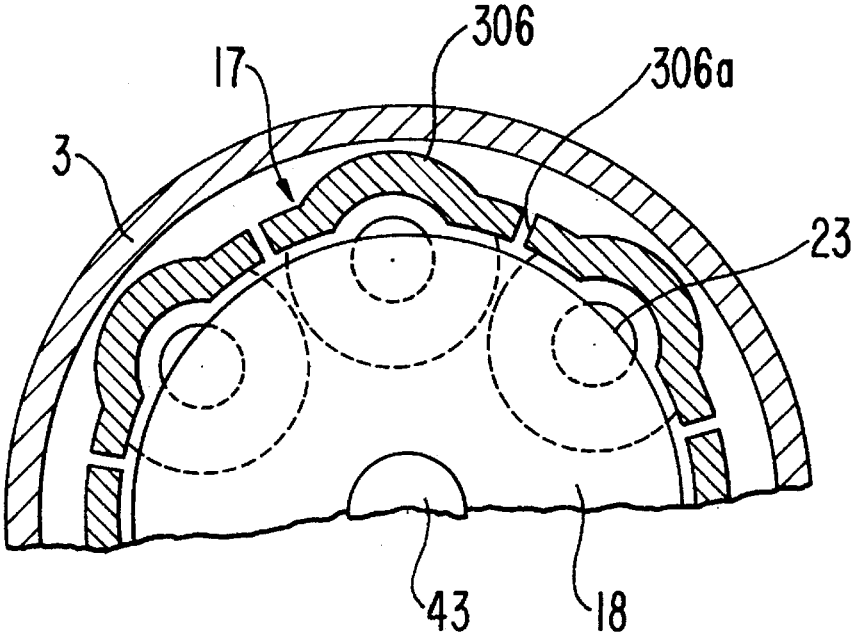
FIG. 8*b* is a cross-sectional view taken along line 2*b*—2*b* in FIG. 1 in accordance with the sixth embodiment of the present invention.

Referring to FIGS. 8*a* and 8*b*, piston 17 is depicted according to the sixth embodiment of the present invention. Each piston 17 is provided with projection 306 which is integrally formed on, and arches and extends radially from, the center of coupling portion 17*c* of piston 17. Projection 306 includes axial end surface 306*a* formed on the radial end thereof. Each axial end portion 306*a* of projection 306 abuts the adjacent axial end portion 306*a*, so that adjacent end portions slide against each other as the pistons 17 reciprocate.

The above-described surfaces of the rotation prevention means formed on piston 17, such as radial end portion 301*a* in FIGS. 3*a* and 3*b*, groove 302*a* in FIGS. 4*a* and 4*b*, groove 303*a* in FIGS. 5*a* and 5*b*, outer peripheral surface 304*a* in FIGS. 6*a* and 6*b*, groove 305 in FIGS. 7*a* and 7*b*, and axial end surface 306*a* in FIGS. 8*a* and 8*b* are machined, e.g., by milling or grinding during a finishing process, to have fine surfaces. The surface roughness ($R_a$) of these fine surfaces is less than about 1.6 μm (ANSI B46.1-1978). Such fine surfaces improve the anti-seizure and wear resistance of the above-described rotation prevention means when sliding against peripheral surfaces 6*a* of bolts 6 as in FIGS. 3*a* through 5*b*, peripheral surfaces 50*d* of cutout portions 50*a* of ring member 50 as in FIGS. 6*a* and 6*b*, peripheral surfaces 50*c* of projections 50*b* of ring member 50 as in FIGS. 7*a* and 7*b*, and adjacent axial end surfaces 306*a* as in FIGS. 8*a* and 8*b*. Further, peripheral surfaces 6*a* of bolts 6, peripheral surfaces 50*d* of cutout portions 50*a* of ring member 50, and peripheral surfaces 50*c* of projections 50*b* of ring member 50 are formed have fine surfaces as described above. Moreover, these surfaces may be coated with a surface treatment, such as a PTFE plating, a chromate treatment, and a ceramic coating, after machining in a finishing process in order to provide sufficient slidability, wear resistance, and durability.

Therefore, in this invention, the area of the above-described slidably contacting surfaces which are machined to have fine surfaces is considerably less than that of the prior art because the various embodiments of the rotation prevention means of piston 17 are designed to partly slide on rotation prevention members fixed to the inside of cylinder block 3 or bolts 6. Further, it is not necessary to finish the inside surface of cylinder block 3 with a finishing tool because other members, such as ring member 50, are provided to slidably contact the above-described rotation prevention means of piston 17 and to prevent piston 17 from rotating about its own axis.

Figure 9A:
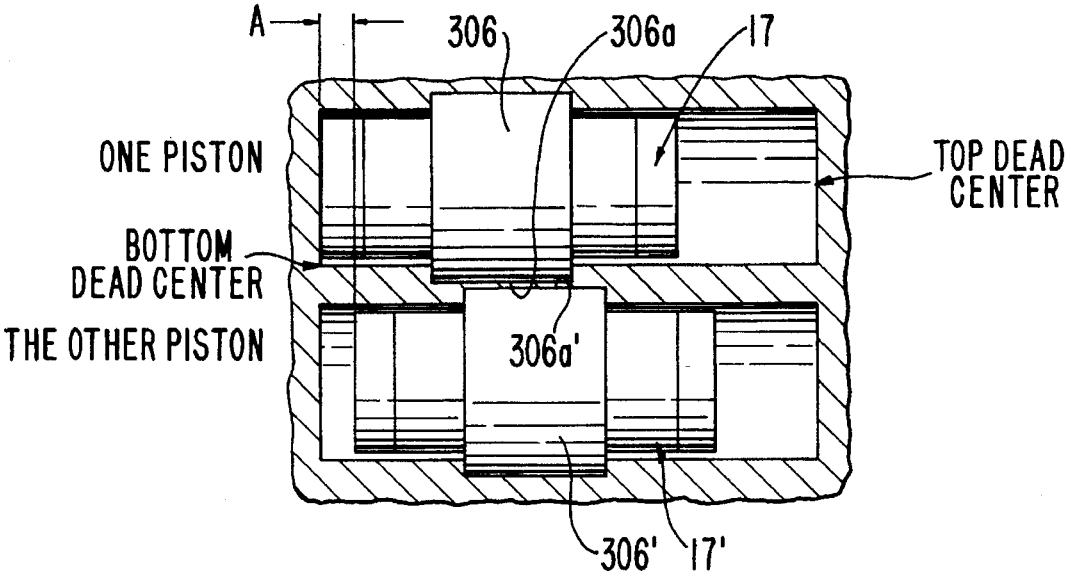
FIG. 9*a* is a schematic view showing two pistons moving in a reciprocated compressing motion, the rotation prevention means of which slide against each other in accordance with FIGS. 8*a* and 8*b*.
Figure 9B:
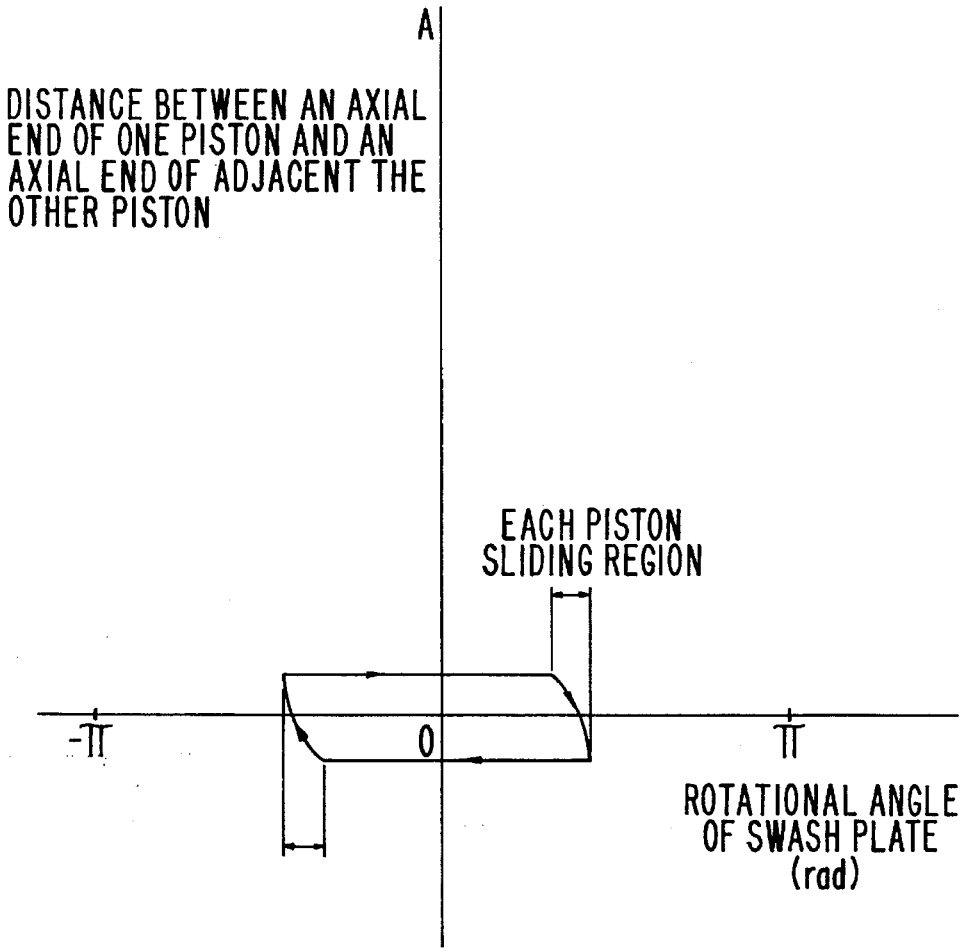
FIG. 9*b* is a graph showing the distance changes between an axial end of one piston and an axial end of the other piston according to rotational angle changes of a swash plate in accordance with FIG. 8*a* and 8*b*.

Additionally, in relation to the sixth embodiment as shown FIGS. 8*a* and 8*b* and referring to FIGS. 9*a* and 9*b*, the period during which axial end portion 306*a* of projection 306 smoothly slides on an adjacent axial end portion 306*a*' is less than the period during which contacting surfaces slide against each other in the first through fifth embodiments. This sliding period is shorter because piston 17 and adjacent piston 17' are reciprocated together and maintain a constant distance A between the axial end of piston 17 and the axial end of adjacent piston 17' until arriving at bottom dead center or top dead center and because axial end portion 306*a* and adjacent axial end portion 306*a*' only smoothly slide on each other immediately before and after arriving at bottom dead center or top dead center of piston 17 or adjacent piston 17' respectively. Accordingly, excessive wear of rotation prevention means such as axial end portions 306*a* and 306*a*' can be effectively reduced.

Although the present invention has been described in connection with the preferred embodiments, the invention is not limited thereto. It will be easily understood by those of ordinary skill in the art that variations and modifications can be easily made within the scope of this invention as defined by the following claims.

The invention claimed is:

1. A piston type compressor comprising:

a compressor housing enclosing a crank chamber, a suction chamber, and a discharge chamber therein, said compressor housing including a cylinder block;

a plurality of cylinders formed in said cylinder block;

a plurality of pistons slidably disposed within each of said cylinders, each of said pistons having a corresponding axis;

a drive shaft rotatably supported in said cylinder block;

a plate tiltably connected to said drive shaft;

a bearing coupling said plate to said pistons, so that said pistons may be driven in a reciprocating motion within said cylinders upon rotation of said plate;

at least one working chamber defined by an end of each of said pistons and an inner surface of each of said cylinders;

a support portion disposed coaxially with said drive shaft and tiltably supporting a central portion of said plate;

a tilt control device driving said support portion axially along said drive shaft to move a central portion of said plate axially along said drive shaft to change the angle of tilt of said plate, said pistons adapted to be reciprocally moved in said cylinders in accordance with a tilting motion of said plate; and a rotation prevention mechanism preventing each of said pistons from rotating about said corresponding axis, said rotation prevention mechanism including a first rotation prevention device formed on a center of said piston and a second rotation prevention device disposed within said compressor housing, said first rotation prevention device having at least one first sliding surface formed thereon, said second rotation prevention device having at least one second sliding surface formed on a peripheral surface thereof, said first sliding surface of said first rotation prevention device smoothly sliding on said second sliding surface of said second rotation prevention device, so that said first rotation prevention device and said second rotation prevention device cooperate to prevent each of said pistons from rotating about said corresponding axis, wherein said first rotation prevention device comprises a projection extending from a center of said piston, said projection having a semicylindrical groove formed thereon, and wherein said second rotation prevention device comprises a rotation prevention member fixed to the inside of said compressor housing, and wherein an entire surface of said semicylindrical groove is in sliding contact with a surface of said rotation prevention member.

2. The piston type compressor of claim 1 said rotation prevention member comprising a bolt connecting said compressor housing and said cylinder block.

3. The piston type compressor of claim 1, wherein said first sliding surface of said first rotation prevention device is formed to be a fine surface having a surface roughness which is less than about 1.6 μm.

4. The piston type compressor of claim 1, wherein said second sliding surface of said second rotation prevention device is formed to be a fine surface a having surface roughness which is less than about 1.6 μm.

5. The piston type compressor of claim 1, wherein said first sliding surface of said first rotation prevention device and said second sliding surface of said second rotation prevention device are formed to be fine surfaces having a surface roughness which is less than about 1.6 μm.

6. The piston type compressor of claim 1, wherein said compressor is a swash plate type compressor.

7. A piston type compressor comprising:

a compressor housing enclosing a crank chamber, a suction chamber, and a discharge chamber therein, said compressor housing including a cylinder block;

a plurality of cylinders formed in said cylinder block;

a plurality of pistons slidably disposed within each of said cylinders, each of said pistons having a corresponding axis;

a drive shaft rotatably supported in said cylinder block;

a plate tiltably connected to said drive shaft;

a bearing coupling said plate to said pistons, so that said pistons may be driven in a reciprocating motion within said cylinders upon rotation of said plate;

at least one working chamber defined by an end of each of said pistons and an inner surface of each of said cylinders;

a support portion disposed coaxially with said drive shaft and tiltably supporting a central portion of said plate;

a tilt control device driving said support portion axially along said drive shaft to move a central portion of said plate axially along said drive shaft to change the angle of tilt of said plate, said pistons adapted to be reciprocally moved in said cylinders in accordance with a tilting motion of said plate; and a rotation prevention mechanism preventing each of said pistons from rotating about said corresponding axis, said rotation prevention mechanism including a first rotation prevention device formed on a center of said piston and a second rotation prevention device disposed within said compressor housing, said first rotation prevention device having at least one first sliding surface formed thereon, said second rotation prevention device having at least one second sliding surface formed on a peripheral surface thereof, said first sliding surface of said first rotation prevention device smoothly sliding on said second sliding surface of said second rotation prevention device, so that said first rotation prevention device and said second rotation prevention device cooperate to prevent each of said pistons from rotating about said corresponding axis, said first rotation prevention device comprising a projection extending from a center of said piston and said second rotation prevention device comprising a rotation prevention member fixed to the inside of said compressor housing, said second rotation prevention device further comprising a ring member fixed to the inside of said compressor housing.

8. The piston type compressor of claim 7, said second rotation prevention device further comprising a projection corresponding to each cylinder, formed in said ring member.

9. A piston type compressor comprising:

a compressor housing enclosing a crank chamber, a suction chamber, and a discharge chamber therein, said compressor housing including a cylinder block;

a plurality of cylinders formed in said cylinder block;

a plurality of pistons slidably disposed within each of said cylinders, each of said pistons having a corresponding axis;

a drive shaft rotatably supported in said cylinder block;

a plate tiltably connected to said drive shaft;

a bearing coupling said plate to said pistons, so that said pistons may be driven in a reciprocating motion within said cylinders upon rotation of said plate;

at least one working chamber defined by an end of each of said pistons and an inner surface of each of said cylinders;

a support portion disposed coaxially with said drive shaft and tiltably supporting a central portion of said plate;

a tilt control device driving said support portion axially along said drive shaft to move a central portion of said plate axially along said drive shaft to change the angle of tilt of said plate, said pistons adapted to be reciprocally moved in said cylinders in accordance with a tilting motion of said plate; and a rotation prevention mechanism .preventing each of said pistons from rotating about said corresponding axis, said rotation prevention mechanism including a first rotation prevention device formed on a center of said piston and a second rotation prevention device disposed within said compressor housing, said first rotation prevention device having at least one first sliding surface formed thereon, said second rotation prevention device having at least one second sliding surface formed on a peripheral surface thereof, said first sliding surface of said first rotation prevention device smoothly sliding on said second sliding surface of said second rotation prevention device, so that said first rotation prevention device and said second rotation prevention device cooperate to prevent each of said pistons from rotating about said corresponding axis, said first rotation prevention device comprising a groove formed on a center of said piston, said second rotation prevention device further comprising a ring member fixed to the inside of said compressor housing.

10. The piston type compressor of claim 9, said second rotation prevention device further comprising a notch corresponding to each cylinder formed in said ring member.

11. A piston type compressor comprising:

a compressor housing enclosing a crank chamber, a suction chamber, and a discharge chamber therein, said compressor housing including a cylinder block;

a plurality of cylinders formed in said cylinder block;

a plurality of pistons slidably disposed within each of said cylinders, each of said pistons having a corresponding axis;

a drive shaft rotatably supported in said cylinder block;

a plate tiltably connected to said drive shaft;

a bearing coupling said plate to said pistons so that said pistons may be driven in a reciprocating motion within said cylinders upon rotation of said plate;

at least one working chamber defined by each end of each of said pistons and an inner surface of each of said cylinders;

a support portion disposed coaxially with said drive shaft and tiltably supporting a central portion of said plate;

a tilt control device driving said support portion axially along said drive shaft to move a central portion of said plate axially along said drive shaft to change the angle of tilt of said plate, said pistons adapted to be reciprocally moved in said cylinders in accordance with a tilting motion of said plate; and a rotation prevention mechanism preventing each of said pistons from rotating about said corresponding axis, said rotation prevention mechanism including a rotation prevention device formed on a center of said piston, said rotation prevention device including at least two sliding surfaces formed on both radial sides of said piston, each of said sliding surfaces of said rotation prevention device smoothly sliding on an adjacent sliding surface of an adjacent rotation prevention device of an adjacent piston, so that said rotation prevention device and said adjacent rotation prevention device cooperate to prevent said piston from rotating about said corresponding axis, wherein a maximum radial thickness of said rotation prevention device is smaller than a diameter of said piston.

12. The piston type compressor of claim 1, wherein said sliding surfaces of said rotation prevention device are formed to be fine surfaces having a surface roughness which is less than about 1.6 μm.

13. The piston type compressor of claim 1, wherein said compressor is a swash type plate compressor.

14. A piston type compressor comprising:

a compressor housing enclosing a crank chamber, a suction chamber, and a discharge chamber therein, said compressor housing including a cylinder block;

a plurality of cylinders formed in said cylinder block;

a plurality of pistons slidably disposed within each of said cylinders, each of said pistons having a corresponding axis;

a drive shaft rotatably supported in said cylinder block;

a plate tiltably connected to said drive shaft and adapted to be rotated together with said drive shaft;

a bearing coupling said plate to said pistons, so that said pistons may be driven in a reciprocating motion within said cylinders upon rotation of said plate;

at least one pair of working chambers defined by each end of each of said pistons and an inner surface of each of each of said cylinders;

a support portion disposed coaxially with said drive shaft and rotatably and tiltably supporting a central portion of said plate;

a tilt control device driving said support portion axially along said drive shaft to move a central portion of said plate axially along said drive shaft to change the angle of tilt of said plate, said pistons adapted to be reciprocally moved in said cylinders in accordance with a tilting motion of said plate; and a rotation prevention mechanism preventing each of said pistons from rotating about said corresponding axis, said rotation prevention mechanism including a first rotation prevention device formed on a center of said piston and a second rotation prevention device disposed within said compressor housing, said first rotation prevention device having a first projection having a first sliding surface formed thereon and a second projection having a second sliding surface formed thereon, said second rotation prevention device comprising a first rotation prevention member having a third sliding surface formed on a peripheral surface thereof and a second rotation prevention member having a fourth sliding surface formed on a peripheral surface thereof, said first sliding surface of said first projection smoothly sliding on said third sliding surface of said first rotation prevention member and said second sliding surface of said second projection smoothly sliding on said fourth sliding surface of said second rotation prevention member, so that said first rotation prevention device and said second rotation prevention device cooperate to prevent each of said pistons from rotating about said corresponding axis.

15. The piston type compressor of claim 14, wherein said compressor is a swash plate type compressor.

16. The piston type compressor of claim 14, wherein a groove is formed in at least one of said first and second projections.

17. The piston type compressor of claim 14, wherein at least one of said first and second rotation prevention members comprises a bolt connecting said compressor housing and said cylinder block.

18. The piston type compressor of claim 14, wherein at least one of said first and second sliding surfaces of said first rotation prevention device is formed to be a fine surface having a surface roughness which is less than about 1.6 μm.

19. The piston type compressor of claim 14, wherein at least one of said third and fourth sliding surfaces of said second rotation prevention device is formed to be a fine surface a having surface roughness which is less than about 1.6 μm.

20. The piston type compressor of claim 14, wherein at least one of said first and second sliding surfaces of said first rotation prevention device and at least one of said third and fourth sliding surfaces of said second rotation prevention device are formed to be fine surfaces having a surface roughness which is less than about 1.6 μm.

21. A piston type compressor comprising:

a compressor housing enclosing a crank chamber, a suction chamber, and a discharge chamber therein, said compressor housing including a cylinder block;

a plurality of cylinders formed in said cylinder block;

a plurality of pistons slidably disposed within each of said cylinders, each of said pistons having a corresponding axis;

a drive shaft rotatably supported in said cylinder block;

a plate tiltably connected to said drive shaft;

a bearing coupling said plate to said pistons, so that said pistons may be driven in a reciprocating motion within said cylinders upon rotation of said plate;

at least one working chamber defined by an end of each of said pistons and an inner surface of each of said cylinders;

a support portion disposed coaxially with said drive shaft and tiltably supporting a central portion of said plate;

a tilt control device driving said support portion axially along said drive shaft to move a central portion of said plate axially along said drive shaft to change the angle of tilt of said plate, said pistons adapted to be reciprocally moved in said cylinders in accordance with a tilting motion of said plate; and a rotation prevention mechanism preventing each of said pistons from rotating about said corresponding axis, said rotation prevention mechanism including a first rotation prevention device formed on a center of said piston and a second rotation prevention device disposed within said compressor housing, said first rotation prevention device having at least one first sliding surface formed thereon, said second rotation prevention device having at least one second sliding surface formed on a peripheral surface thereof, said first sliding surface of said first rotation prevention device smoothly sliding on said second sliding surface of said second rotation prevention device, so that said first rotation prevention device and said second rotation prevention device cooperate to prevent each of said pistons from rotating about said corresponding axis, wherein said second rotation prevention device comprises a ring member fixed to the inside of said compressor housing.

22. The piston type compressor of claim 16, said ring member having a plurality of projections formed therein, each of said projections corresponding to one of said cylinders, said first rotation prevention device comprising a groove formed on a center of said piston, for receiving one of said projections.

23. The piston type compressor of claim 16, said first rotation prevention device comprising a projection extending from a center of said piston, said ring member having a plurality of notches formed therein, each of said notches corresponding to one of said cylinders, one of said notches receiving said projection.

24. A piston type compressor comprising:

a compressor housing enclosing a crank chamber, a suction chamber, and a discharge chamber therein, said compressor housing including a cylinder block;

a plurality of cylinders formed in said cylinder block;

a plurality of pistons slidably disposed within each of said cylinders, each of said pistons having a corresponding axis;

a drive shaft rotatably supported in said cylinder block;

a plate tiltably connected to said drive shaft;

a bearing coupling said plate to said pistons, so that said pistons may be driven in a reciprocating motion within said cylinders upon rotation of said plate;

at least one working chamber defined by an end of each of said pistons and an inner surface of each of said cylinders;

a support portion disposed coaxially with said drive shaft and tiltably supporting a central portion of said plate;

a tilt control device driving said support portion axially along said drive shaft to move a central portion of said plate axially along said drive shaft to change the angle of tilt of said plate, said pistons adapted to be reciprocally moved in said cylinders in accordance with a tilting motion of said plate; and a rotation prevention mechanism preventing each of said pistons from rotating about said corresponding axis, said rotation prevention mechanism including a first rotation prevention device formed on a center of a first one of said pistons, a second rotation prevention device formed on a center of a second one of said pistons, and a third rotation prevention device disposed within said compressor housing, said first rotation prevention device having a first sliding surface formed thereon, said second rotation prevention device having a second sliding surface formed thereon, said third rotation prevention device having a third sliding surface on a peripheral surface thereof, said first sliding surface of said first rotation prevention device and said second sliding surface of said second rotation prevention device smoothly sliding on said third sliding surface of said third rotation prevention device, so that said first second and third rotation prevention devices cooperate to prevent each of said pistons from rotating about said corresponding axis;

wherein an axis of said piston is radially and circumferentially offset from an axis of said third rotation prevention device.

* * * * *